United States Patent [19]

Mueller

[11] Patent Number: 4,524,716

[45] Date of Patent: Jun. 25, 1985

[54] ADJUSTABLE AIR KNIFE

[75] Inventor: Hans J. Mueller, Appleton, Wis.

[73] Assignee: Appleton Papers Inc., Appleton, Wis.

[21] Appl. No.: 571,808

[22] Filed: Jan. 18, 1984

[51] Int. Cl.[3] ..... B05C 11/06

[52] U.S. Cl. ..... 118/665; 118/63

[58] Field of Search ..... 118/665, 63, 21; 239/569; 15/307, 306 A

[56] References Cited

U.S. PATENT DOCUMENTS 2,139,628 12/1938 Terry ..... 118/63 X 3,499,418 3/1970 Mayhew ..... 118/665

3,941,086 3/1976 Roncan ..... 118/63

*Primary Examiner*—John P. McIntosh

*Attorney, Agent, or Firm*—Birch, Stewart, Kolasch & Birch

[57] ABSTRACT

An improved gas knife wherein a coating which is generally uniform across the width of a paper web can be applied thereto. The gas knife contains a flexible gas flow modification member located adjacent to the inside of the nozzle of the gas knife for modifying the flow of gas whereby the coating weight can be adjusted differentially across a web being coated.

16 Claims, 3 Drawing Figures

ADJUSTABLE AIR KNIFE

TECHNICAL FIELD

The present invention relates to an adjustable gas knife useful in connection with a coating apparatus. More specifically, the coating apparatus is useful for forming a uniform paper coating across a paper web.

BACKGROUND ART

Air knives for adjusting the thickness of a coating on a surface to be coated are known in the art as evidenced, for example, by U.S. Pat. Nos. 3,753,418 and 3,841,557. However, the air knives heretofore available are not entirely suitable for coating a layer onto a paper web.

DISCLOSURE OF THE INVENTION

The present invention is directed to an improved gas knife wherein a coating can be applied to a paper web which is generally uniform across the width of the web. Paper coatings are often non-uniform across the paper web because of non-uniform paper surfaces, changes in absorption properties and other unknown reasons. Therefore, it is very beneficial to be able to adjust the amount of coat weight differentially across a paper web to achieve a paper web with uniformity and quality. The coating which is applied to the paper web can be any functional paper coating such as coatings utilized to prepare carbonless paper, etc. A method and apparatus in which the air knife of the present invention is preferably employed is disclosed in U.S. Pat. No. 3,632,378 dated Jan. 4, 1972 which is hereby incorporated by reference.

The adjustable air knife of the present invention comprises elongated nozzle means for projecting a sheet of gas, flexible gas flow modification means located adjacent to the inside of the nozzle for modifying the flow of the gas and adjusting means for adjusting the position of the gas flow modification means at a plurality of positions across the length of the gas flow modification means whereby the coating weight of a coating can be adjusted differentially across a web being coated. The gas flow modification means is preferably an elongate flexible bar which is conformally shaped to the inside surface of the nozzle means. In a preferred embodiment the elongate flexible bar has a generally truncated triangular cross section.

The adjusting means may comprise a plurality of adjusting shafts capable of moving sections of the gas flow modification means toward and away from the opening of the elongate nozzle means. In a preferred embodiment, the adjusting means comprises a plurality of adjusting shafts which pass through a primary gas supply chamber and a nozzle chamber wherein one end of each of the adjusting shafts is connected with the gas flow modification means and the other end of each of the adjusting shafts is adapted for adjustment thereof. The primary gas supply chamber may contain a plurality of openings which connect the primary gas supply chamber with the nozzle chamber whereby the adjusting shafts can pass through respective ones of said openings.

In a preferred embodiment the adjustable gas knife comprises a gas pipe connected with a supply of compressed gas, said gas pipe containing a plurality of openings located along one longitudinal surface thereof; an elongate upper blade located outside of the gas pipe and connected with the gas pipe; an elongate lower blade located outside of and connected with said gas pipe, said lower blade being arranged adjacent to and parallel with the upper blade to define an elongate nozzle and an elongate nozzle chamber located between the nozzle and the gas pipe openings; an elongate gas flow modification member located within the nozzle chamber and being arranged adjacent to the inside of the nozzle; adjusting means for adjusting the position of the flow modification member, said adjusting means comprising: a plurality of adjusting shafts arranged along the length of the gas knife, each of the adjusting shafts being connected at one end with the gas flow modification member and being connected at the other end with a wall of the gas pipe opposite to the gas pipe openings; and means for imparting motion to the adjusting shafts to thereby change the position of the gas flow modification member within the nozzle chamber. Adjusting shaft support means such as sleeve bearings may be located in the gas pipe openings for supporting the adjusting shafts between the ends thereof.

When the gas knife of the present invention is incorporated into a coating apparatus, the coating apparatus comprises: web support means for supporting a web of material to be coated; conveying means for conveying the web of material; coating means for applying a coating material to at least one surface of the web; and an elongate adjustable gas knife arranged adjacent to the coated surface of the web material, said gas knife including, elongate nozzle means for projecting a sheet of gas against the coated surface, flexible gas flow modification means located adjacent to the inside of the nozzle for modifying the flow of the gas, and adjusting means for adjusting the position of the gas flow modification means at a plurality of positions along the length of the gas flow modification means. When automatic operation and adjustment of the gas knife is desired, the coating apparatus further includes sensing means for sensing the coat weight on the web at a plurality of positions across the width of the web, wherein the adjusting means is an automatic adjusting means responsive to the sensing means for adjusting the gas flow modification means to provide a uniform coating on the web. The automatic adjusting means may comprise a plurality of servomotors responsive to the sensing means and operably connected with the gas flow modification means in a plurality of positions along the length thereof. The servo motors are controlled by a feedback loop control circuit which is responsive to the coating weight sensed by a plurality of coating sensors.

DESCRIPTION OF THE PREFERRED EMBODIMENT

Figure 1:
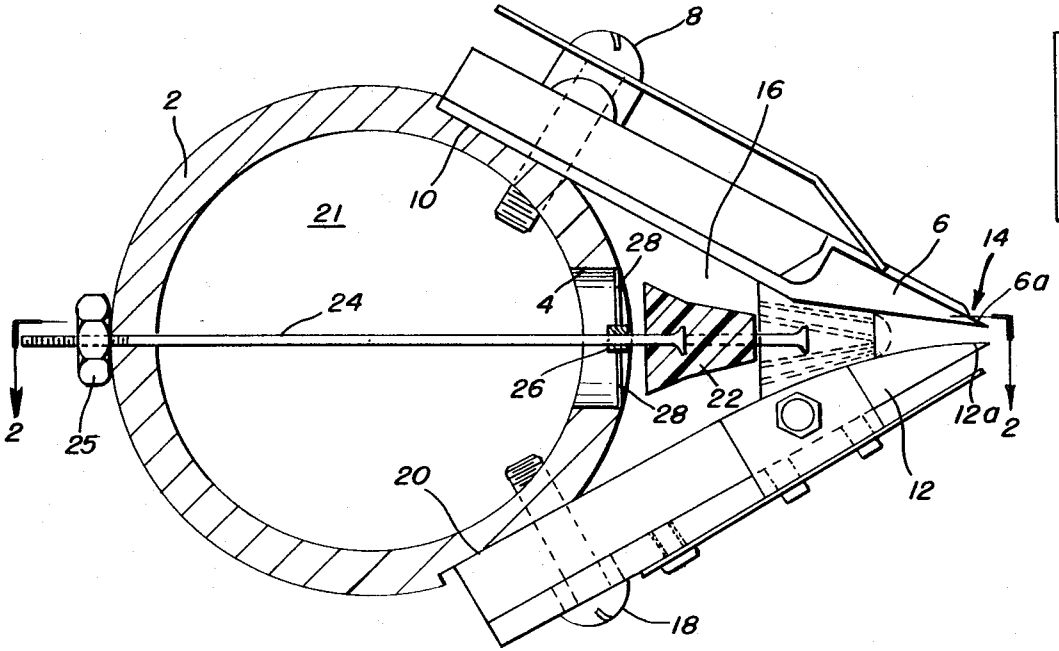
FIG. 1 is a cross-sectional view of the adjustable gas knife of the present invention.
Figure 2:
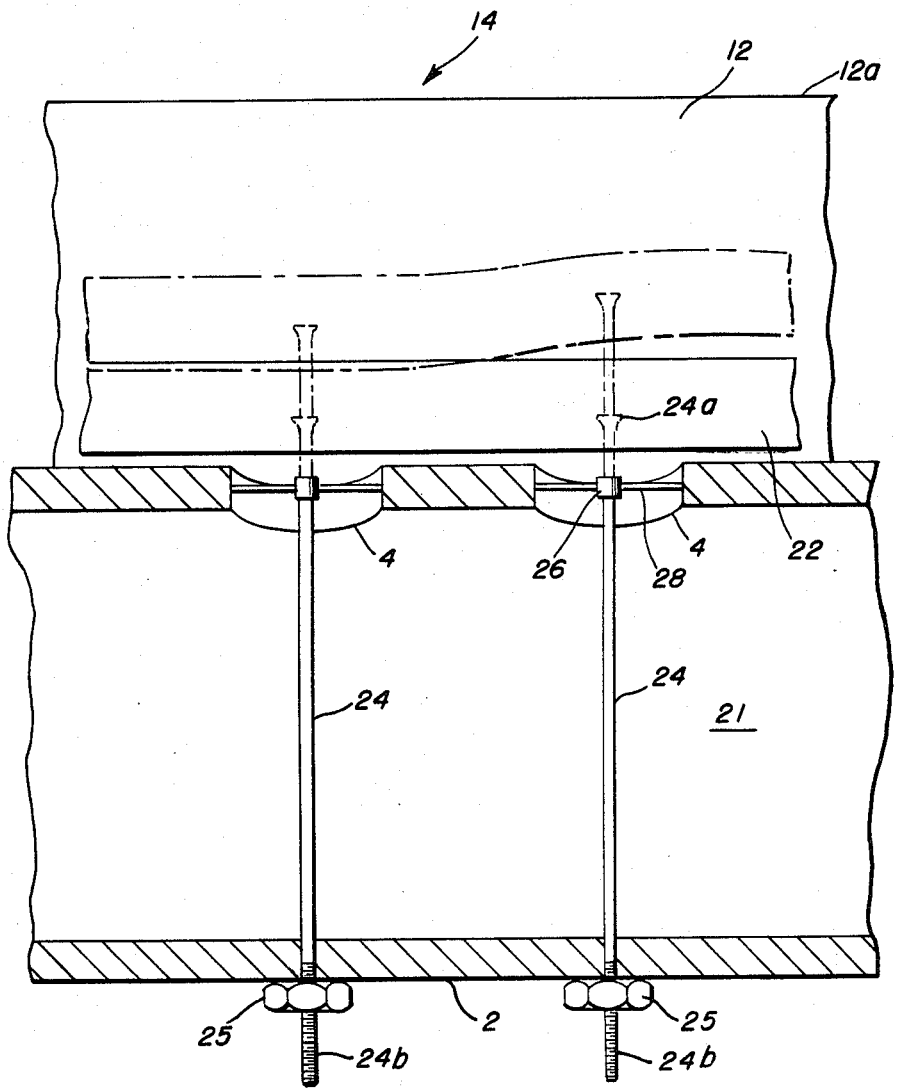
FIG. 2 is a sectional view of the adjustable gas knife of the present invention taken along line 2—2 in FIG. 1.

As shown in FIGS. 1 and 2, the adjustable gas knife of the present invention is formed of an elongate air pipe 2 having a plurality of openings 4 formed therein. The air pipe is connected with a supply of compressed gas such as air or another suitable compressed gas. The gas knife contains an adjustable upper blade 6 which is adjustably connected with the gas pipe by a plurality of bolts 8. The upper blade is adjusted to the proper position manually before the apparatus is put into operation since the primary adjustment during operation is accomplished by an elongate gas flow modification member as will be discussed further hereinbelow. The upper blade 6 can be slidably adjusted in an adjustment slot or depression 10 which is formed on the outer surface of the air pipe 2. The gas knife also contains an elongate lower blade 12 located outside of and connected with the gas pipe wherein the lower blade is arranged adjacent to and parallel with the upper blade whereby the lip 6*a* of the upper blade and the lip 12*a* of the lower blade define an elongate nozzle 14 and an elongate nozzle chamber 16 located between the nozzle 14 and the gas pipe openings 4. The lower blade 12 is adjustably connected with the gas pipe 2 by a plurality of bolts 18 or other suitable connecting members. The lower blade 12 is mounted on the air pipe 2 in an adjustment slot or depression 20.

Gas flow from an air supply chamber 21 to the elongate nozzle 14 is modified and controlled by an elongate gas flow modification member 22 which is located within the nozzle chamber and which is arranged adjacent to the inside of the nozzle. The gas flow modification member 22 is preferably conformally shaped to the inside surface of the elongate nozzle 14 and has solid smooth surfaces. The elongate gas flow modification member 22 may be formed from a flexible or semi-flexible soft rubber having grooved surfaces which aid the laminar flow of air. The gas flow modification member may also have an air hole or air holes formed therein to induce laminar flow. The elongate gas flow modification member can be formed of rubber, plastic or any flexible material such as a nylon or Teflon rod.

The position of the gas flow modification member 22 is controlled at a plurality of locations by a plurality of adjusting shafts 24. One longitudinal end of the adjusting shaft 24*a* is connected with the gas flow modification member and the other end of the adjusting shaft 24*b* passes through a wall of the air pipe opposite to the openings 4. The adjusting shafts may be adjusted manually by an adjustment nut 25 or by servomotors in the automatic mode. The adjusting shafts 24 are supported in the opening 4 by a sleeve bearing 26 which is supported in the opening by a plurality of bearing support members 28. The bearing support members 28 are arranged in the opening 4 and allow passage of air through the openings.

Figure 3:
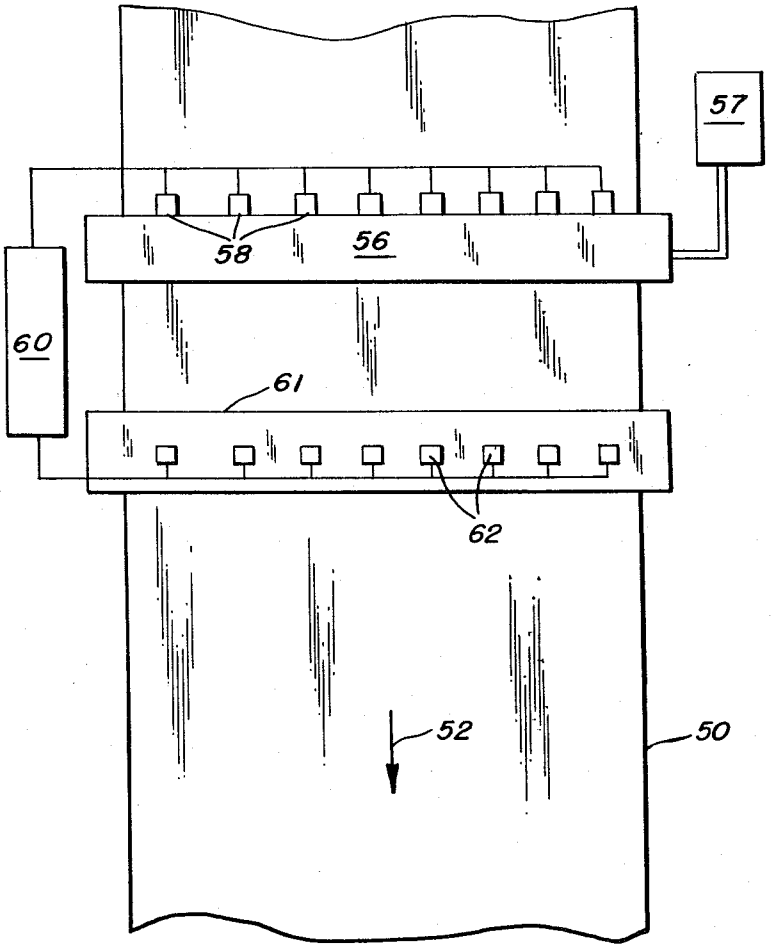
FIG. 3 is a schematic view of a coating apparatus employing the adjustable gas knife of the present invention.

In operation, as shown in FIG. 3, a paper web 50 is conveyed along a web support by a conveying means in the direction of the arrow 52. A coating material is applied to the paper web by a coating applicator arranged within the air knife coating station 56. The air knife which is connected with a source of compressed gas 57 directs an elongate sheet of air onto the coating material as the paper web passes underneath the air knife. A coating weight profile sensor 61 containing a plurality of coating sensors 62 senses the thickness of the coating material at a plurality of locations after it passes beneath the air knife coating station 56. Alternatively, pairs of sensors 61 are located one before and one after the air knife coating station 56. Alternatively, the coating weight profile sensor 61 may be a single sensing device which scans back and forth across the width of the moving web. The coating weight profile scanner sends appropriate signals to a feedback control circuit 60 which sends appropriate signals to a plurality of servomotors 58 which adjust the position of the gas flow modification member. By utilizing the coating apparatus of the present invention, coated paper having high quality and uniformity can be produced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An adjustable gas knife, comprising:

elongated nozzle means having an elongated nozzle opening for projecting a sheet of gas;

elongated flexible gas flow modification means located within said nozzle for modifying the rate of flow of said gas; and differential adjusting means for selectively adjusting the position of said gas flow modification means relative to said nozzle opening at a plurality of positions along the length of said gas flow modification means to thereby selectively modify the rate of flow of said gas through said nozzle opening.

2. The gas knife of claim 1, wherein said flexible gas flow modification means is an elongate flexible bar shaped conformally to the inside surface of said nozzle means.

3. The gas knife of claim 2, wherein said elongate flexible bar has a generally truncated triangular cross section.

4. The gas knife of claim 1, wherein said differential adjusting means comprises a plurality of adjusting shafts capable of moving sections of said gas flow modification means toward and away from said elongated nozzle opening.

5. The gas knife of claim 1, which comprises a primary gas supply chamber and a nozzle chamber wherein said gas flow modification means is located within said nozzle chamber.

6. The gas knife of claim 5, wherein said differential adjusting means comprises a plurality of adjusting shafts which pass through said primary gas supply chamber and said nozzle chamber, one end of each of said adjusting shafts being connected with said gas flow modification means and the other end of each of said adjusting shafts being adapted for adjustment thereof.

7. The gas knife of claim 5, wherein said primary gas supply chamber has a plurality of openings which connect the gas supply chamber with the nozzle chamber.

8. The gas knife of claim 7, wherein said adjusting means comprises a plurality of adjusting shafts which pass through said openings.

9. An adjustable gas knife, comprising:

a gas pipe connected with a supply of compressed gas, said gas pipe containing a plurality of openings located along one longitudinal surface thereof;

an elongate upper blade located outside of said gas pipe and connected with said gas pipe;

an elongate lower blade located outside of and connected with said gas pipe, said lower blade being arranged adjacent to and parallel with said upper blade to define an elongated nozzle opening and an elongate nozzle chamber located between said nozzle opening and said gas pipe openings;

an elongate gas flow modification member located within said nozzle chamber and being arranged inside of said nozzle;

adjusting means for adjusting the position of said flow modification member, said adjusting means comprising:

a plurality of adjusting shafts arranged along the length of said gas knife, each of said adjusting shafts being connected at one end with said gas flow modification member and being connected at the other end with a wall of said gas pipe opposite to said gas pipe openings; and means for imparting motion to said adjusting shafts to thereby change the position of said gas flow modification member within said nozzle chamber.

10. The gas knife of claim 9, wherein said adjusting shafts pass through corresponding of said openings in said gas pipe.

11. The gas knife of claim 10, and further including adjusting shaft support means located in said gas pipe openings for supporting said adjusting shafts.

12. The gas knife of claim 11, wherein said adjusting shaft support means are sleeve bearings.

13. A coating apparatus, comprising:

web support means for supporting a web of material to be coated;

conveying means for conveying said web of material;

coating means for applying a coating material to at least one surface of said web; and an elongate adjustable gas knife arranged adjacent to said coated surface of web material, said gas knife including, elongate nozzle means having an elongated nozzle opening for projecting a sheet of gas against said coated surface, elongated flexible gas flow modification means located within said nozzle means for modifying the rate of flow of said gas, and differential adjusting means for selectively adjusting the position of said gas flow modification means at a plurality of positions along the length of said gas flow modification means to thereby selectively modify the rate of flow of said gas through said nozzle opening.

14. The coating apparatus of claim 13, and further including sensing means for sensing the coat weight on said web at a plurality of positions across the width of said web, wherein said differential adjusting means is an automatic differential adjusting means responsive to said sensing means for adjusting said gas flow modification means to provide a uniform coating on said web.

15. The coating apparatus of claim 14, wherein said automatic differential adjusting means comprises a plurality of servomotors responsive to said sensing means and operably connected with said gas flow modification means at a plurality of positions along the length thereof.

16. The coating apparatus of claim 13, wherein said gas flow modification means is an elongate flexible bar shaped conformally to the inside surface of said nozzle means.

* * * * *